US006200095B1

(12) United States Patent
Bucher et al.

(10) Patent No.: US 6,200,095 B1
(45) Date of Patent: Mar. 13, 2001

(54) WIRE DIVERTER FOR DOWNRODS OF CEILING FANS

(75) Inventors: John C. Bucher, Ft. Lauderdale; Charles E. Bucher, Valrico, both of FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/393,499

(22) Filed: Sep. 10, 1999

(51) Int. Cl.[7] ..... F04D 29/00
(52) U.S. Cl. ..... 416/5; 416/244 R
(58) Field of Search ..... 416/5, 170 R, 416/244 R; 417/423.7, 423.144

(56) References Cited

U.S. PATENT DOCUMENTS 4,073,598 * 2/1978 Mizutani et al. ..... 416/5
4,637,673 * 1/1987 Yang ..... 339/89 M
4,810,207 * 3/1989 Butterfield ..... 439/529
4,871,327 * 10/1989 Ridgway et al. ..... 439/543

* cited by examiner

*Primary Examiner*—Edward K. Look
*Assistant Examiner*—Ninh Nguyen
(74) *Attorney, Agent, or Firm*—Holland & Knight LLP

(57) ABSTRACT

A ceiling fan comprises a motor, a down rod, a hanging ball, and a coupler pin for engaging the upper end of the down rod with the hanging ball. A diverter is installed at the upper end of the down rod to divert the electrical wiring from the fan motor to a non-obstructive position relative to the coupler pin within the down rod.

15 Claims, 6 Drawing Sheets

WIRE DIVERTER FOR DOWNRODS OF CEILING FANS

BACKGROUND OF THE INVENTION

1. Field of the Invention

This invention relates to ceiling fans. More particularly, this invention relates to down rods for ceiling fans that function to suspend a ceiling fan downwardly from a ceiling fan bracket assembly mounted to an electrical receptacle box in the ceiling.

2. Description of the Background Art

Motor-driven fans suspended from a ceiling were used extensively in homes in the United States to provide air circulation before the introduction and popularization of central cooling units.

When the energy crisis dawned in the 1970's, the cost of a kilowatt hour skyrocketed in price and consumers searched for ways to reduce their heating and cooling costs. It has been well established that properly circulated air will raise the overall thermal efficiency of the home air conditioning and cooling system and hence, reduce the cost of maintaining a home at a desired comfort level year-around. Thus, ceiling fans were repopularized in the 1970's.

Indeed, ceiling fans have become so popular that competitiveness in the industry often depends on the ease of installing one ceiling fan versus another. Hence, modern ceiling fans are designed with features that allow the do-it-yourselfer to quickly and easily install a ceiling fan. For example, hanger brackets have been optimized for ease in installation such as that disclosed in our co-pending patent application entitled "Ceiling Fan Bracket, Canopy and Canopy Hole Cover", Ser. No. 09/128,849, filed Aug. 4, 1998, the disclosure of which is hereby incorporated by reference herein. Most of such ease-of-installation designs comprise a hanger bracket that is intended to be mounted to the electrical receptacle box in the ceiling. The hanger bracket includes a socket portion for receiving a hanger ball rigidly mounted to the upper end of a hollow downrod. The lower end of the downrod is then connected to a motor coupler of the motor housing. A cotter pin is often provided for preventing the pin from working loose.

During assembly, the wires to the motor and to the light kit of the ceiling fan extend from the hollow motor shaft and are threaded through the hollow downrod for connection to the household wiring in the electrical receptacle box in the ceiling. Typically, the hanger ball is factory-installed to the upper end of the downrod by means of a hanger ball pin. During installation, the bundle of wires are threaded through the lower end downrod to extend upwardly therefrom, whereupon another safety pin is used for rigidly connecting the downrod to the coupler of the motor. The hanger ball is then fitted into the socket portion of the hanger bracket for suspension of the ceiling fan. The wires are then connected to the household wiring in the electrical receptacle box.

As may be appreciated, the pin for the hanger ball extends transversely through the downrod and thus at least partially obstructs the threading of the bundle of wires therethrough. Further, as may also be appreciated, once the bundle of wires is threaded through the downrod, they obstruct the insertion of the coupler pin through the coupler and the downrod. In other words, the coupler pin must be inserted through the holes on one side of the coupler and downrod, weaved through the bundle of wires to move them from one side to the other so that the end of the pin can be aligned with and inserted through the opposing holes in the downrod and coupler, without nicking or otherwise abrading any of the wires. Even if the wires are not nicked, the do-it-yourself installer often becomes frustrated with having to thread the bundle of wires through the downrod without being obstructed by the hanger ball pin and with having to connect the downrod to the coupler by weaving the coupler pin through the bundle of wires without damage to the wires.

In view of the foregoing, there exists a need in the ceiling fan industry for increasing the ease in which down rods may be connected to the coupler of ceiling fans by do-it-yourself installers.

Therefore, it is an object of this invention to provide an improvement which overcomes the aforementioned inadequacies of the prior art devices and provides an improvement which is a significant contribution to the advancement of the ceiling fan art.

Another object of this invention is to provide a ceiling fan including a downrod, a coupler mounted to a ceiling fan motor, a coupler pin for insertion through holes in the downrod and corresponding holes in the coupler for rigidly securing the downrod and the coupler together; and a diverter for diverting motor wires extending from the ceiling fan motor to a non-obstructive position relative to the coupler pin, whereby the ceiling fan may be easily installed by a do-it-yourselfer installer.

Another object of this invention is to provide a ceiling fan including a downrod a hanger ball, a hanger ball pin for insertion through holes in the downrod and corresponding seats in the hanger ball for rigidly securing the downrod and the hanger ball together, and a diverter for diverting motor wires extending from a ceiling fan motor to a non-obstructive position relative to the hanger ball pin.

Another object of this invention is to provide a ceiling fan including a downrod, a coupler mounted to a ceiling fan motor, a coupler pin for insertion through holes in the downrod and corresponding holes in the coupler for rigidly securing the downrod and the coupler together, and a diverter for diverting motor wires extending from the a hollow motor shaft of a ceiling fan motor to a non-obstructive position relative to the coupler pin.

Another object of this invention is to provide a ceiling fan including a downrod, a coupler mounted to a ceiling fan motor, a coupler pin for insertion through holes in the downrod and corresponding holes in the coupler for rigidly securing the downrod and the coupler together, and a hollow diverter sleeve that is press-fitted into the holes of the downrod and dimensioned to slidably receive the coupler pin.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, the invention comprises a diverter for diverting the bundles of wires that extend through a downrod of a ceiling fan to the side of the downrod such that the bundle of wires may be more easily threaded through the downrod without being obstructed by the coupler pin that interconnects the hanger ball to the end of the downrod and such that the coupler pin may be easily inserted through the aligned holes of the downrod and coupler without being obstructed by the bundle of wires extending through the downrod. More particularly, the diverter according to the subject invention comprises many embodiments, some specifically intended for use in diverting the wires at the upper end of the downrod so that the wires are not obstructed or hindered from being threaded through the downrod by the hanger ball pin that interconnects the hanger ball to the upper end of the downrod and in some other embodiments intended for use in connection with either the lower end of the downrod or with the coupler itself such that the bundle of wires extending from the hollow motor shaft through the downrod are diverted to the side so that the coupler pin may be inserted through the aligned holes of the downrod and coupler without being obstructed by the bundle of wires.

Each of the various embodiments of the diverter of the invention is intended to increase the ease of installing a ceiling fan by a do-it-yourself installer. Moreover, each of the embodiments are intended to be factory-installed so that the do-ityourself installer achieves the benefits of the diverter without increasing the number of assembly steps that must be undertaken by the installer as would otherwise be the case if the diverter was not factory installed. Moreover, each of the embodiments of the diverter of the invention are designed to be compatible with existing designs of down rods, hanger balls and couplers so that tooling for such components need not be redesigned just to be compatible with the diverter of the invention.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 16 is a top plan view of FIG. 14;

Similar reference characters refer to similar parts throughout the several views of the drawings.

DETAILED DESCRIPTION OF THE PREFERRED EMBODIMENT

Figure 1:
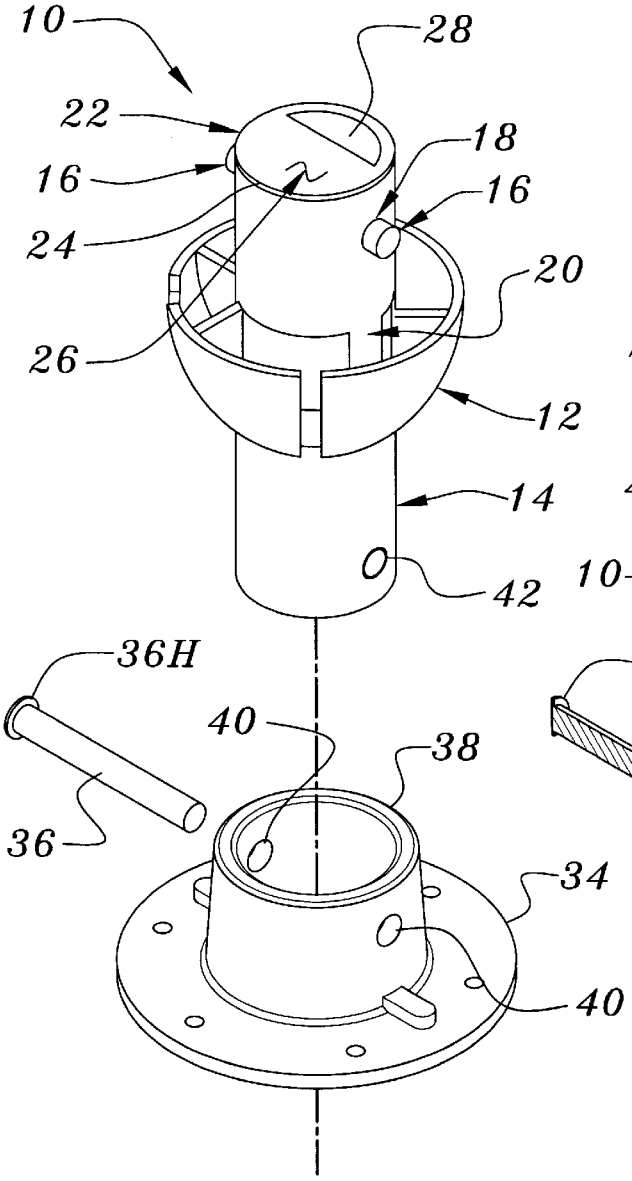
FIG. 1 is an exploded diagram of a downrod and coupler having the diverters of the invention incorporated therein.

FIGS. 1–6 illustrate the preferred embodiment for the diverter 10 of the invention for use in connection with the hanger ball 12 that is connected to the upper end of a hollow downrod 14 by means of a hanger ball pin 16 that is inserted through opposing holes 18 formed in the walls of the downrod 14. As illustrated, the hanger ball pin 16 conventionally includes an increased length so that its ends extend beyond the opposing holes 18 of the downrod 14 and may be seated in corresponding seats 20 integrally formed in the hanger ball 12 once the hanger ball 12 is slid upwardly from the position shown in FIGS. 1 and 2 to be substantially flush with the upper end of the downrod 14.

Figure 6:
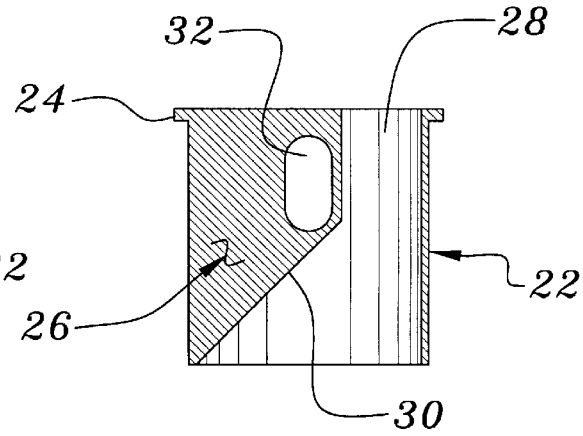
FIG. 6 is a longitudinal cross-sectional view of FIG. 5 illustrating the solid and open portions of the diverter plug.
Figure 9:
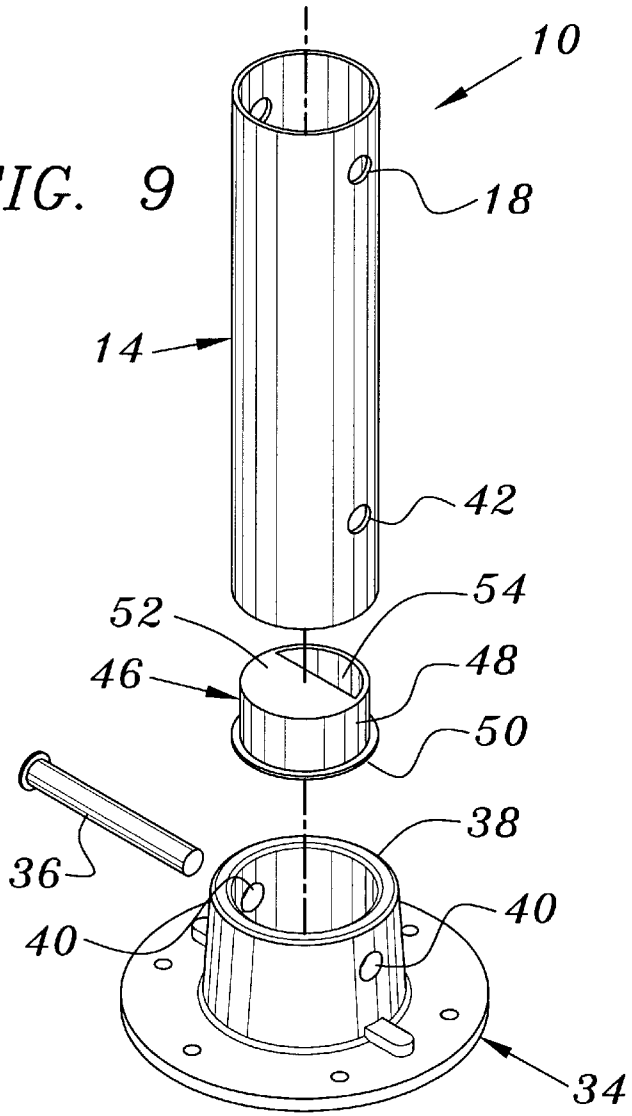
FIG. 9 is an exploded view of FIG. 7 showing the intended insertion of the diverter plug into the lower end of the downrod.
Figure 8:
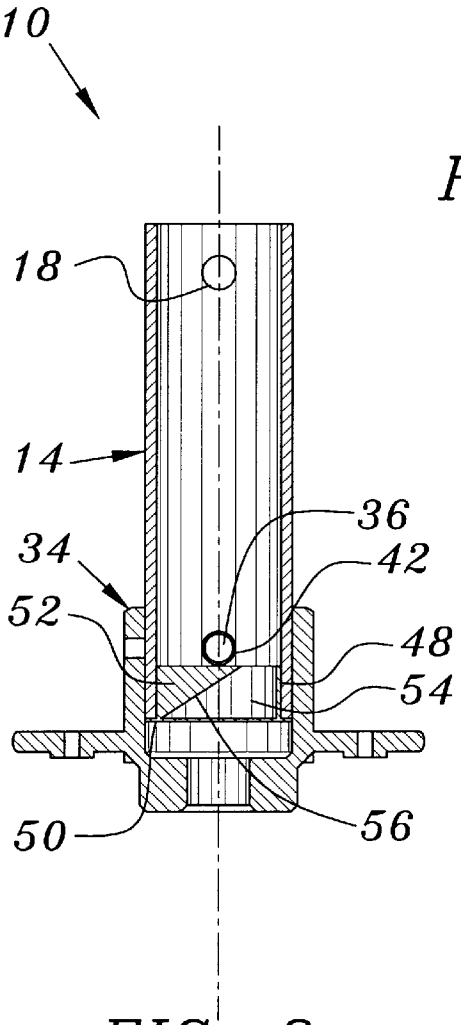
FIG. 8 is a longitudinal cross-sectional view of FIG. 7.
Figure 7:
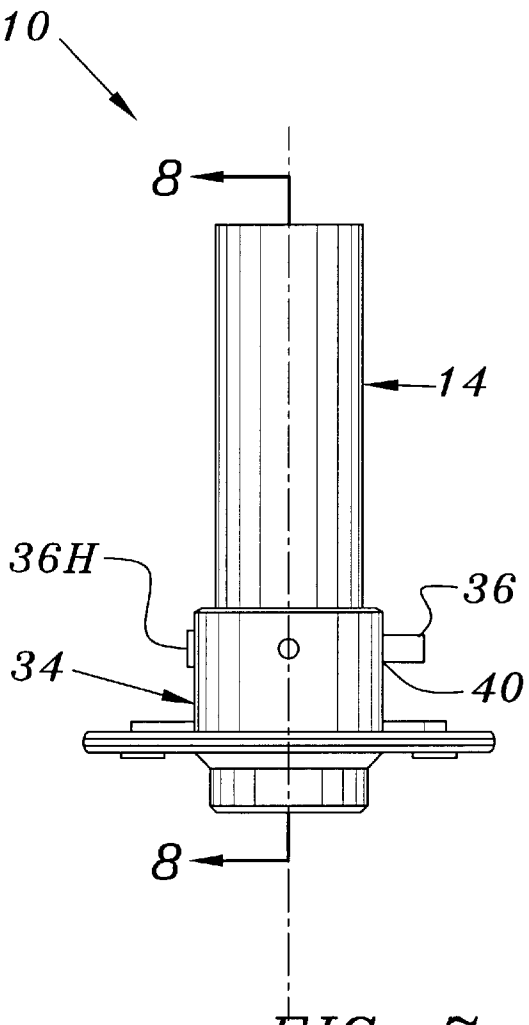
FIG. 7 is a side elevational view of an assembled downrod and coupler having another embodiment of a diverter plug of the invention incorporated therein.
Figure 10:
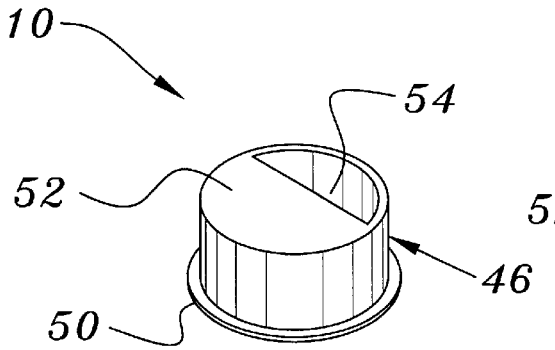
FIG. 10 is a top perspective view of the diverter plug of FIG. 7.
Figure 11:
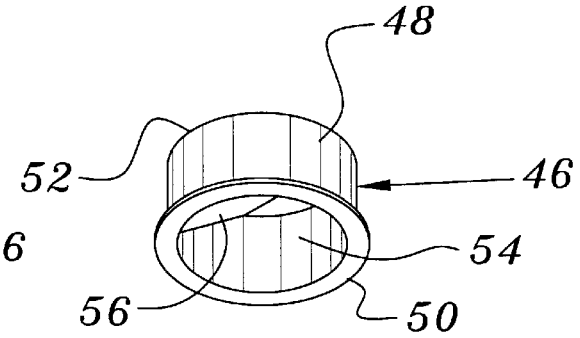
FIG. 11 is a bottom perspective view of the diverter plug of FIG. 7.
Figure 12:
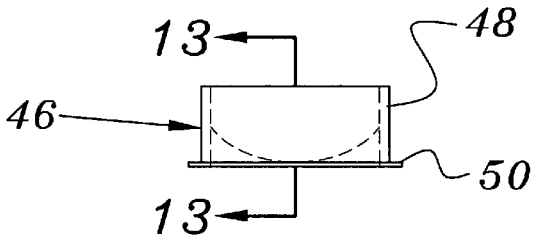
FIG. 12 is a side elevational view of the diverter plug of the invention.
Figure 13:
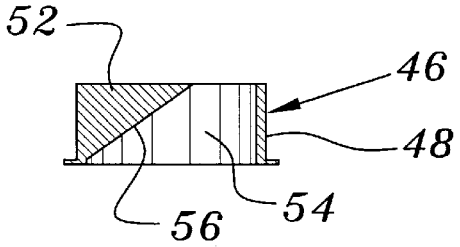
FIG. 13 is a longitudinal cross-sectional view of FIG. 12.
Figure 18:
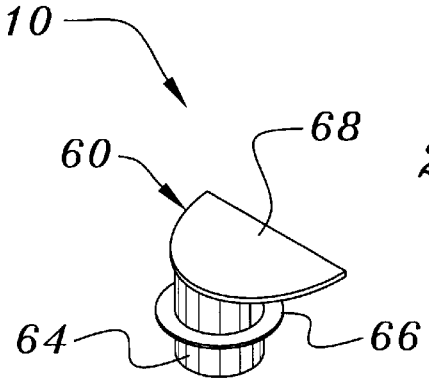
FIG. 18 is an upper perspective view of the diverter cap of the invention.
Figure 19:
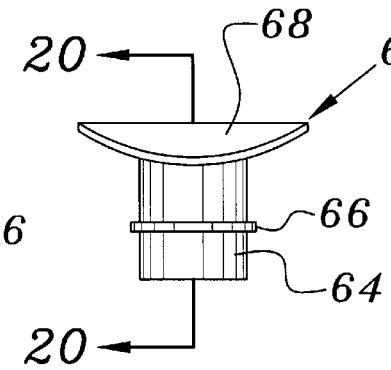
FIG. 19 is a side plan view of the diverter cap of the invention.
Figure 20:
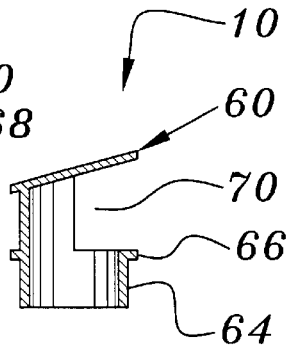
FIG. 20 is a longitudinal cross-sectional view of FIG. 19.

The first embodiment of the diverter 10 of the invention is best illustrated in FIGS. 3–6 and includes a diverter plug 22 having an outer dimension configured to be press-fitted into the upper end of the hollow downrod 14. The diverter plug 22 preferably comprises a lip 24 that seats onto the upper edge of the downrod 14. The diverter plug 22 comprises a partially-hollow configuration including a solid portion 26 and a hollow portion 28. The solid portion 26 preferably extends from one side to beyond the center of the diverter plug 22 as best shown in FIG. 6. Further, the solid portion 26 includes an inwardly-sloping surface 30 that slopes upwardly relative to the upper end of the downrod 14. A diametric hole 32 is formed within the solid portion 26 for alignment with the hanger ball pin 16.

Figure 2:
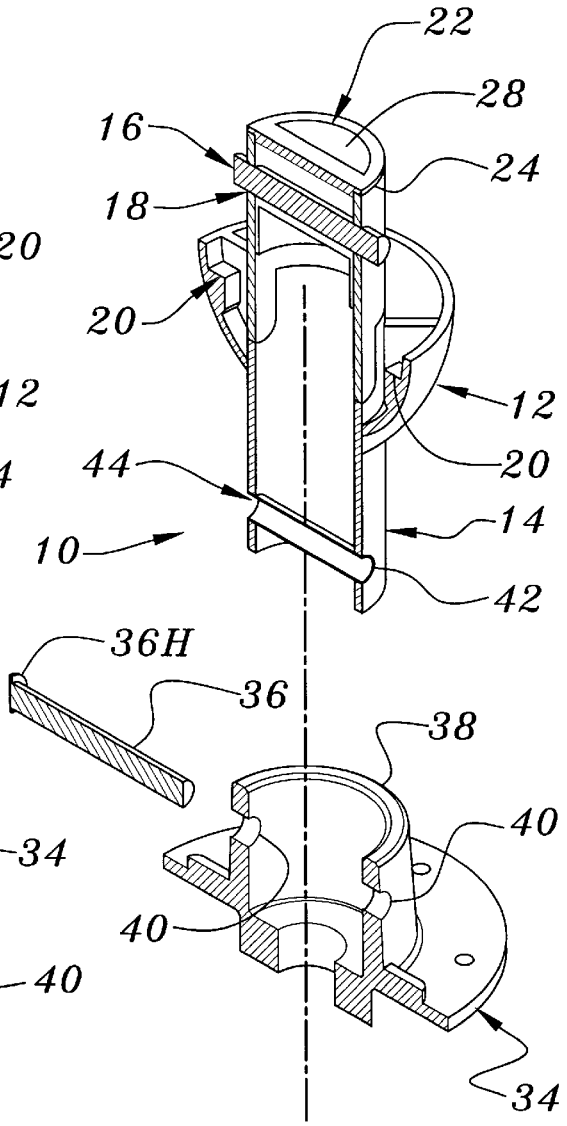
FIG. 2 is a longitudinal cross-sectional view of FIG. 1.
Figure 3:
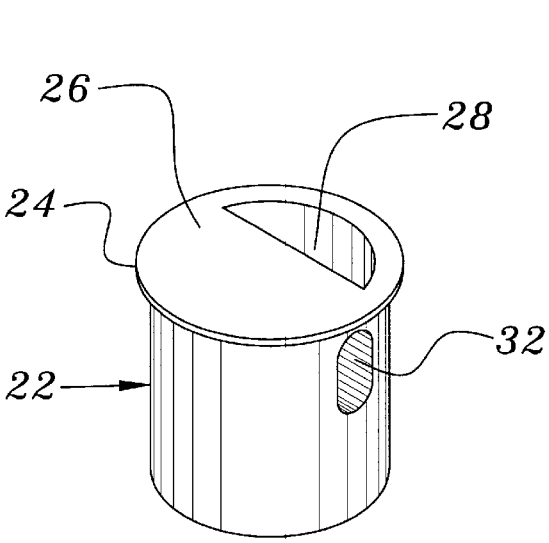
FIG. 3 is a top perspective view of the diverter plug of the invention.
Figure 4:
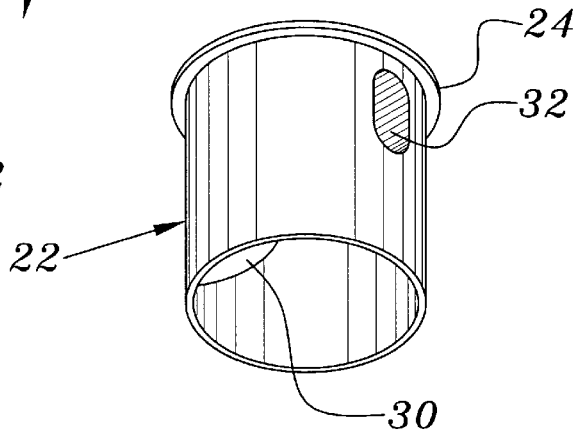
FIG. 4 is a bottom perspective view of the diverter plug of the invention.
Figure 5:
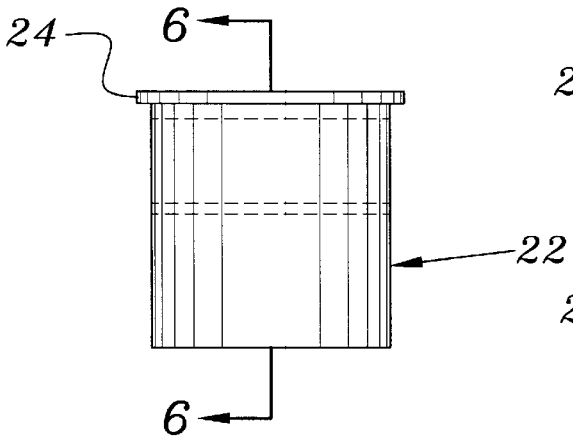
FIG. 5 is a side view of the diverter plug of the invention.

During assembly, the diverter plug 22 is factory installed by press fitting into the upper end of the downrod 14 with the diametric hole 32 in the solid portion 26 being aligned with the opposing holes 18 formed in the wall of the hollow downrod 14. The hanger ball pin 16 is then installed through the holes 18 and 32 to extend outwardly from both sides of the downrod 14 as shown in FIGS. 1 and 2. The hanger ball 12 is then slid upwardly to seat the exposed ends of the hanger ball pin 16 into the seats 20 of the hanger ball 12.

It is noted that the diverter plug 22 functions by means of its inwardly sloping surface 30 to divert the bundle of wires that are inserted through the hollow downrod 14 to the side within the downrod 14 to extend then through the hollow portion 28 of the diverter plug 22 to exit the upper end of the downrod 14. The diversion of the bundle of wires to the side within the downrod 14 precludes the hanger ball pin 16 from otherwise being an obstruction to the threading of the wires through the downrod 14.

Moreover, in those instances in which a longer downrod is needed, such as for installation to a cathedral ceiling, the longer downrod may be quickly substituted for the short downrod illustrated in the drawings by removing the hanger ball 12, removing the hanger ball pin 16 and then removing the diverter plug 22 and then reassembling such components into the longer downrod. Thus, it should be appreciated that the diverter plug 22 of the invention significantly increases the ease of installation and is particularly desirable to the do-it-yourself installer that otherwise might become frustrated during the installation process.

The preferred embodiment of the diverter 10 of the invention for use in connection with the lower end of the downrod 14 that is connected to a conventional coupler 34 by means of a coupler pin 36, is shown in FIGS. 1 and 2. More specifically, as is conventional in the art, couplers 34 are typically bolted to the upper surface of the motor assembly and typically include an upstanding hollow boss 38 having opposing holes 40 formed diametrically through the wall thereof for alignment with corresponding holes 42 formed diametrically in the lower end of the downrod 14 for receiving the coupler pin 36 therethrough. The diverter 10 of the invention of this preferred embodiment comprises a hollow diverter sleeve 44 that is press-fitted into the holes 42 of the downrod 14. The hollow diverter sleeve 44 is dimensioned so as to loosely receive the coupler pin 36 therethrough.

During assembly, the hollow diverter sleeve 44 is press-fitted into the downrod hole 42 at the factory. The installer threads the bundle of wires into the lower end of the downrod 14 to one side or the other of the hollow diverter sleeve 44 to then exit the downrod 14 at its upper end. The lower end of the downrod 14 is then fitted into the hollow boss 38 and the respective holes 40 and 42 are aligned. The coupler pin 36 is then simply inserted through the respective holes 40, 42 through the hollow diverter sleeve 44. It is noteworthy that because the hollow diverter sleeve 44 diverts the bundle of wires to the side, the coupler pin 36 is not obstructed in any manner as would otherwise occur without the use of the hollow diverter sleeve 44. Ease of installation for the do-it-yourself installer is again significantly increased and frustrations are minimized. Finally, it is noted that the coupler pin 36 may include a head 36H to keep it from working all the way through the holes 40 and 42 and may include a conventional cotter pin (not shown) at its terminal end to keep it from working itself back out and causing a hazardous condition.

FIGS. 7–13 illustrate another embodiment of the diverter 10 of the invention as a variation of the diverter plug 22 described above. More specifically, in this embodiment, the diverter 10 of the invention comprises a diverter plug 46 which is intended to be press-fitted into the lower end of the downrod 14. The diverter plug 46 of this embodiment comprises an annular side wall 48 dimensioned to be press-fitted into the end of the hollow downrod 14. An annular lip 50 is provided for seating onto the edge of the end of the downrod 14. The diverter cap 46 comprises a solid portion 52 and a hollow portion 54. The solid portion extends from the side to appreciably beyond the center of the diverter plug 46. The lower surface 56 of the solid portion 52 is inwardly sloped in an upwardly direction relative to the upper end of the downrod 14.

Preferably, the diverter plug 46 is factory installed into the lower end of the downrod 14 in an orientation such that the hollow portion 54 is aligned to one side of the opposing holes 42 formed in the end of the downrod 14. In this manner, during installation by the do-it-yourselfer, the bundle of wires may be easily diverted through the hollow portion 54 by means of the inwardly sloping surface 56 to then exit the upper end of the downrod 14. During assembly of the lower end of the downrod 14 to the boss 38 of the coupler 34, the coupler pin 36 may then be easily inserted through the respective holes 40 and 42 inasmuch as the bundle of wires is diverted to the side and does not obstruct or otherwise hinder the insertion of the pin 36 into such holes 40 and 42.

Referring now to FIGS. 14–21, still another embodiment of the diverter 10 of the invention is illustrated wherein such diverter 10 comprises a diverter cap 60 which is intended to be fitted to the upper end of the hollow motor shaft 62. More particularly, the diverter cap 60 comprises a generally hollow configuration having a lower skirt portion 64 which is to be press-fitted into the upper end of the hollow motor shaft 62. Alternatively, the skirt portion 64 may be press-fitted onto the outside of the upper end of the hollow motor shaft 62 without departing from the spirit and scope of this invention. An annular lip 66 is positioned above the skirt portion 64 so as to seat against the upper edge of the hollow motor shaft 62.

The diverter cap 60 further comprises an angled top portion 68 that extends from the side of the diverter cap 60 to a distance appreciably beyond the center of the diverter cap 60 to an open position 70. The angled top portion 68 is angled upwardly relative to the upper end of the motor shaft 62.

Figures 14, 15, 17:
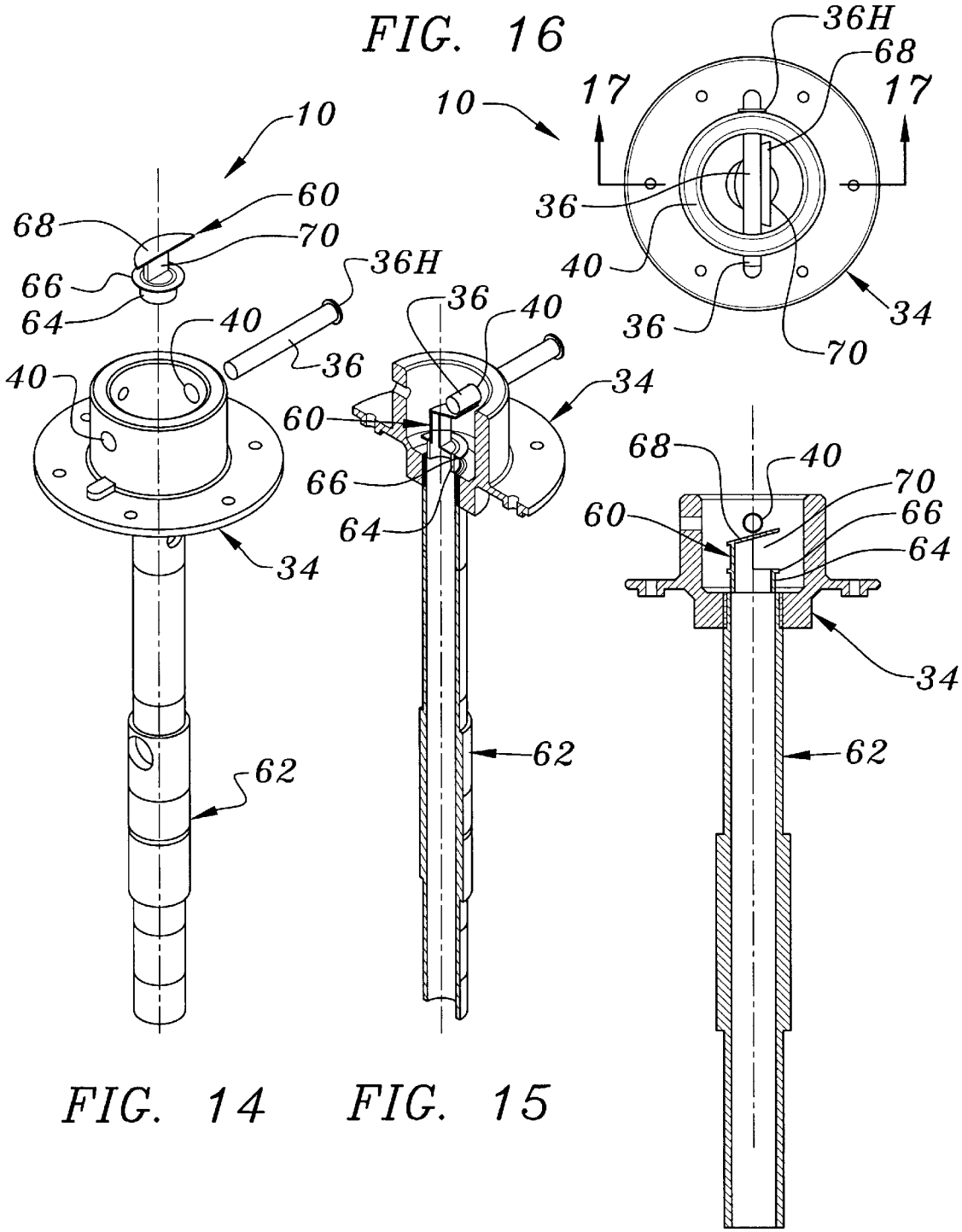
FIG. 14 is an exploded perspective view of another embodiment of the diverter of the invention as comprising a diverter cap that is to be installed into the upper end of the hollow motor shaft of a ceiling fan.
FIG. 15 is a perspective view, in cross-section, of FIG. 14.
FIG. 17 is a longitudinal cross-sectional view of FIG. 16.

During assembly, the bundle of wires that extend through the motor shaft 62 are threaded through the hollow diverter cap 60 first through the skirt portion 64 and then angled upwardly by the angled top portion 68 to the open portion 70 of the diverter cap 60. The cap 60 is then press-fitted into the motor shaft 62. In this manner, the bundle of wires extending upwardly from the open portion 70 of the diverter cap 60 is diverted sideways such that, as best shown in FIGS. 15 and 16, the exiting wires are forcibly diverted to the side of the placement of the coupler pin 36 that is to be inserted through corresponding holes 40 and 42 when the downrod 14 is to be connected to the coupler 34. Thus, it should be appreciated that the diverter cap 60 diverts the wires to a nonobstructive position so that such coupler pin 36 can be easily inserted through the holes 40 and 42 without being blocked or otherwise being interfered by the bundle of wires.

Figure 22:
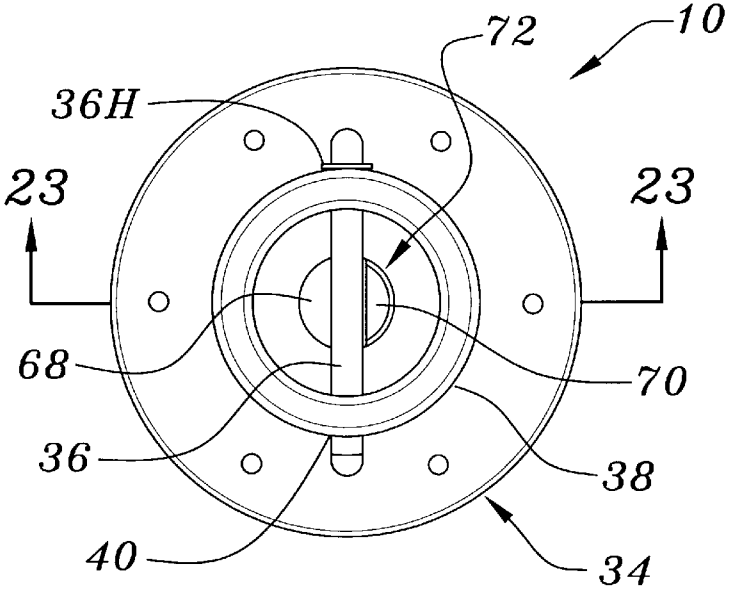
FIG. 22 is a top plan view of the integral diverter cap incorporated within the coupler.
Figure 23:
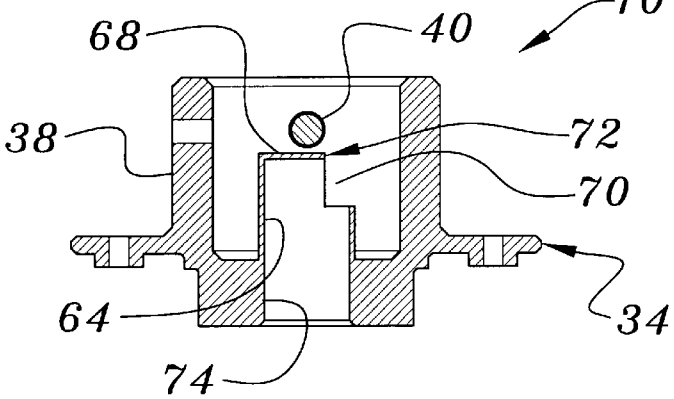
FIG. 23 is a longitudinal cross-sectional view of FIG. 22.
Figure 21:
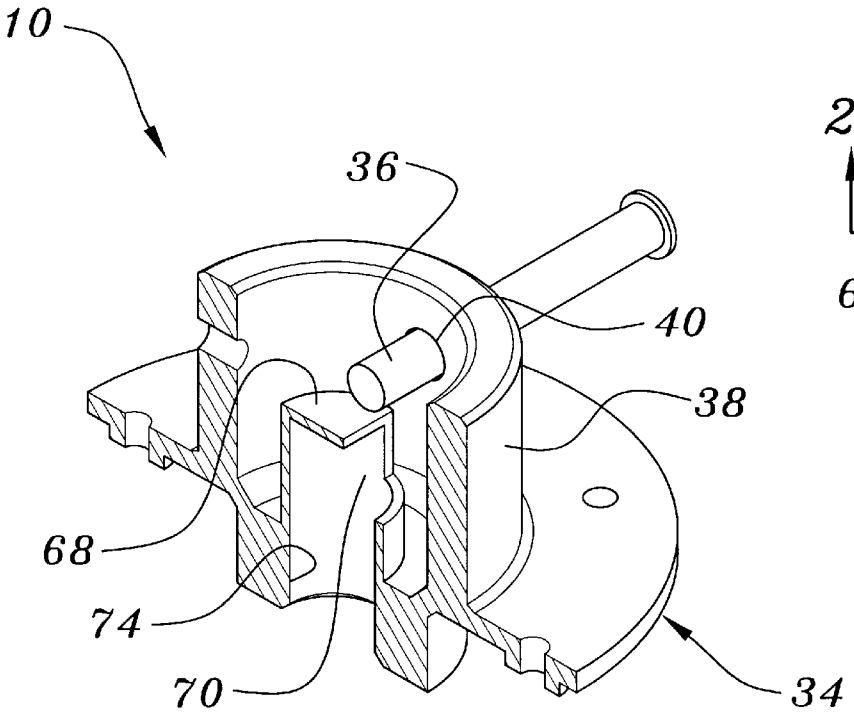
FIG. 21 is a perspective view, in half-section, of an integral diverter cap of the invention formed integrally with the coupler of a ceiling fan.

FIGS. 22–24 illustrate still another embodiment of the diverter 10 of the invention that is similar in construction to the diverter cap 60 described above, but is integrally formed with the coupler 34. More particularly, the integral diverter cap 72 generally comprises a hollow configuration with its skirt portion 64 integrally formed with the hole 74 of the coupler 34 that receives the upper end of the hollow motor shaft 62. The integral diverter cap 72 further includes a top portion 68 that extends from the side of the diverter cap 72 to appreciably beyond the center of the diverter cap 72. The top portion 68 may or may not be angled upwardly or comprise a flat configuration for ease in manufacturing. As in the case of the diverter cap 60, the integral diverter cap 72 functions to divert the bundle of wires extending from the upper end of the hollow motor shaft 62 outwardly from the open portion 70 to the side within the boss 40 of the coupler 34. In this manner, the exiting motor wires are diverted to the side to a position that does not obstruct or otherwise interfere with the insertion of the coupler pin 36 through the respective holes 40 and 42 as the downrod 14 is assembled to the coupler 34.

It should be appreciated that the pins 16 & 36 may comprise a threaded, knurled, smooth or other configuration without departing from the spirit and scope of this invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A ceiling fan comprising a downrod for connection to a coupler of a motor by means of a coupler pin, the improvement comprising:

a diverter for diverting motor wires from the motor to a non-obstructive position relative to the coupler pin.

2. A ceiling fan comprising a hanger ball for connection to a downrod by means of a coupler pin, the improvement comprising:

a diverter for diverting motor wires from a motor to a non-obstructive position relative to the coupler pin.

3. A ceiling fan, comprising in combination:

a downrod;

a coupler mounted to a ceiling fan motor;

a coupler pin for insertion through holes in said downrod and corresponding holes in said coupler for rigidly securing said downrod and said coupler together; and a diverter for diverting motor wires extending from the ceiling fan motor to a non-obstructive position relative to said coupler pin.

4. The ceiling fan as set forth in claim 3, wherein said diverter comprises a diverter plug positioned within a lower end of said downrod.

5. The ceiling as set forth in claim 4, wherein said diverter plug comprises a solid portion and an open portion, said solid portion extending from a side of said diverter plug to a position appreciably beyond a center of said diverter plug.

6. The ceiling fan as set forth in claim 5, wherein said solid portion of said diverter plug comprises an angled configuration.

7. A ceiling fan, comprising in combination:

a downrod;

a hanger ball;

a hanger ball pin for insertion through holes in said downrod and corresponding seats in said hanger ball for rigidly securing said downrod and said hanger ball together; and a diverter for diverting motor wires extending from a ceiling fan motor to a non-obstructive position relative to said hanger ball pin.

8. The ceiling fan as set forth in claim 7, wherein said diverter comprises a diverter plug positioned within an upper end of said downrod.

9. The ceiling as set forth in claim 8, wherein said diverter plug comprises a solid portion and an open portion, said solid portion extending from a side of said diverter plug to a position appreciably beyond a center of said diverter plug.

10. The ceiling fan as set forth in claim 9, wherein said solid portion of said diverter plug comprises an angled configuration.

11. A ceiling fan, comprising in combination:

a downrod;

a coupler mounted to a ceiling fan motor;

a coupler pin for insertion through holes in said downrod and corresponding holes in said coupler for rigidly securing said downrod and said coupler together; and a diverter for diverting motor wires extending from a hollow motor shaft of a ceiling fan motor to a non-obstructive position relative to said coupler pin.

12. The ceiling fan as set forth in claim 11, wherein said diverter comprises a diverter cap positioned relative to said hollow motor shaft.

13. The ceiling as set forth in claim 12, wherein said diverter cap comprises a solid portion and an open portion, said solid portion extending from a side of said diverter cap to a position appreciably beyond a center of said diverter cap.

14. The ceiling fan as set forth in claim 13, wherein said solid portion of said diverter cap comprises an angled configuration.

15. A ceiling fan, comprising in combination:

a downrod;

a coupler mounted to a ceiling fan motor;

a coupler pin for insertion through holes in said downrod and corresponding holes in said coupler for rigidly securing said downrod and said coupler together; and a hollow diverter sleeve that is aligned with said holes of said downrod and dimensioned to slidably receive said coupler pin.

* * * * *